United States Patent [19]

Schmidt, Jr.

[11] Patent Number: 4,878,450

[45] Date of Patent: Nov. 7, 1989

[54] BOAT LIFTING DEVICE

[76] Inventor: Anthony Schmidt, Jr., 3370 N. Key Dr., #1E, North Fort Myers, Fla. 33903

[21] Appl. No.: 211,241

[22] Filed: Jun. 24, 1988

[51] Int. Cl.[4] ..... B63B 21/00

[52] U.S. Cl. ..... 114/259; 114/44; 405/3

[58] Field of Search ..... 114/44, 365, 366, 375, 114/259, 260; 405/3; 212/267; 187/27; 414/137.7

[56] References Cited

U.S. PATENT DOCUMENTS 1,475,290 11/1923 Ellison et al. ..... 114/375 X 2,761,571 9/1956 Adams ..... 114/366 X 3,778,855 12/1973 Kariagin et al. ..... 114/375

4,436,476 3/1984 Yoritomi ..... 212/267 X

*Primary Examiner*—Sherman D. Basinger

*Attorney, Agent, or Firm*—Joseph Zallen

[57] ABSTRACT

A lifting device for small boats which is attached to the rear vertical surface of a larger boat. The device comprises at least two support units each having a hollow vertical tube to the boat and a vertical extension tube movable in the hollow attached tube. Extending from the vertical tube is a horizontal support so that a pair of such supports holds the small boat transversely. The vertical extensions are moved by motor-driven cables.

5 Claims, 2 Drawing Sheets

BOAT LIFTING DEVICE

BACKGROUND OF INVENTION

This invention relates to a lifting device. In particular it relates to a lifting device attached to a boat which permits the raising, storing and lowering of a small craft such as a dinghy.

The following prior art patents relate to boat lifting devices:

| | | | |
|---|---|---|---|
| U.S. Pat. No. 2,057,995 | J. Badovici | Oct. 20, 1936 | LIFEBOAT LAUNCHING |
| U.S. Pat. No. 2,386,650 | L. V. Bell | Oct. 09, 1945 | MOTHER SHIP |
| U.S. Pat. No. 2,530,840 | G. B. Post | Nov. 21, 1950 | HOISTING |
| U.S. Pat. No. 2,761,571 | D. T. Adams | Sept. 04, 1956 | MARINE HOIST |
| U.S. Pat. No. 2,929,081 | H. G. Taylor | Mar. 22, 1960 | DAVITS |
| U.S. Pat. No. 3,143,991 | R. C. Anderson | Aug. 11, 1964 | METHOD AND MECHANISM FOR HOISTING |
| U.S. Pat. No. 3,865,062 | Babb | Feb. 11, 1975 | MARINE GEOPHYSICAL |
| U.S. Pat. No. 3,894,640 | Crook, et al. | July 15, 1975 | APPARATUS |
| U.S. Pat. No. 4,662,300 | McCallum et al. | May 5, 1987 | OFFSHORE |
| U.S. Pat. No. 4,711,196 | Wilks | Dec. 08, 1987 | MARINE SURVIVAL |

These examples of the prior art all have one or more important disadvantages such as costly and complex design, the inability to raise or lower a dinghy with passengers between the deck of the boat and the water, and lack of suitability for a small boat or yacht, as for example a forty-foot boat.

One object of the present invention is to provide a novel boat-lifting device that is suitable for relatively small vessels.

Further objects and advantages of this invention will be apparent from the description and claims which follow.

SUMMARY OF INVENTION

The invention comprises generally a plurality of support units attached to the vertical rear surface or transom of a boat. Each support unit has a horizontal extension so that a dinghy or the like is supported transversely to the boat on the horizontal members. The horizontal members are movable up and down by means of motor-driven cables. The movable vertical members are preferably telescoping into fixed vertical support members.

In addition to being attached to the rear of a boat the support units can be attached to land-based supports adjacent to a sea wall.

SPECIFIC EXAMPLE OF THE INVENTION

Figure 1:
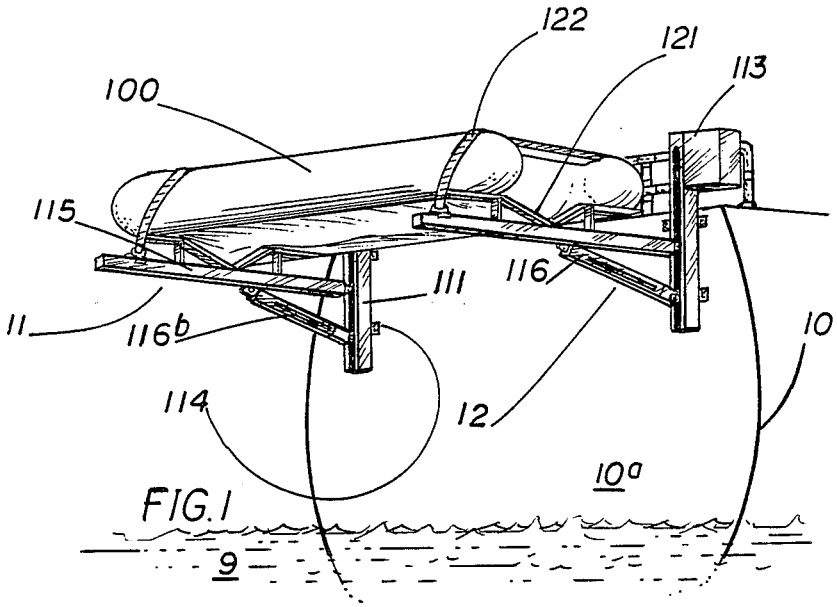
FIG. 1 is a perspective rear view of one embodiment of the invention showing the lifting device in its upper position and holding a dinghy in stored position.
Figure 2:
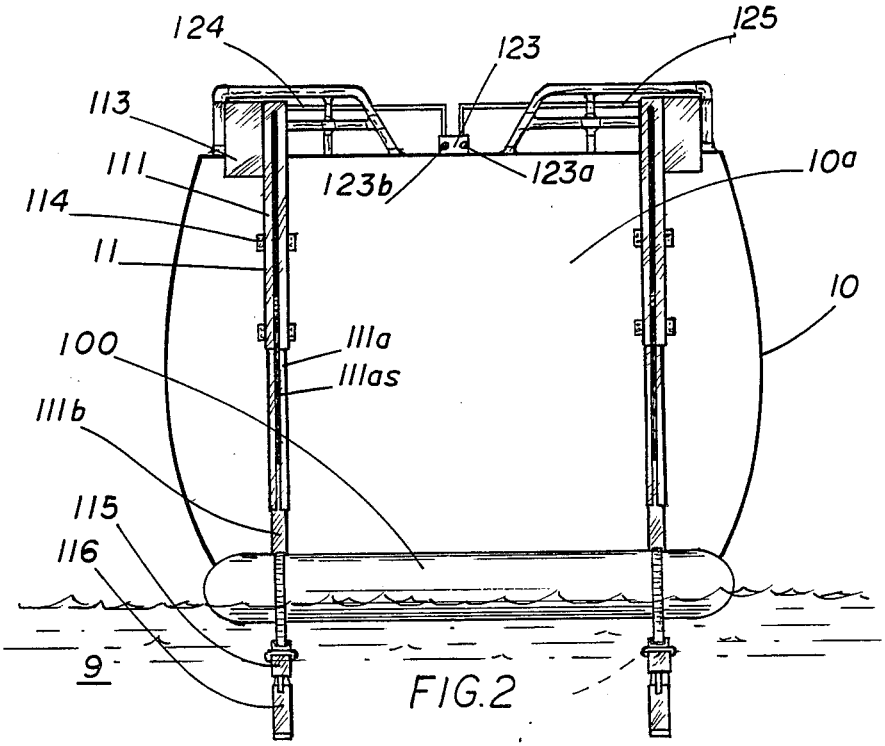
FIG. 2 is a rear view of the embodiment of FIG. 1 showing the device in lowered position whereby the dingy is floating in the water.
Figure 3:
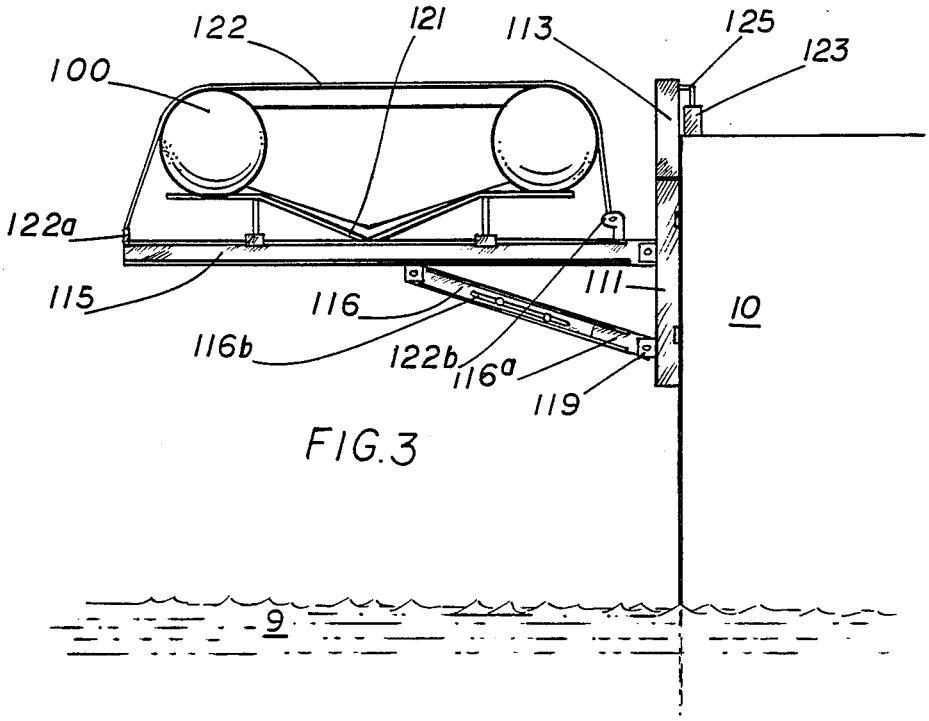
FIG. 3 is a side view of the rear portion of FIG. 1.
Figure 4:
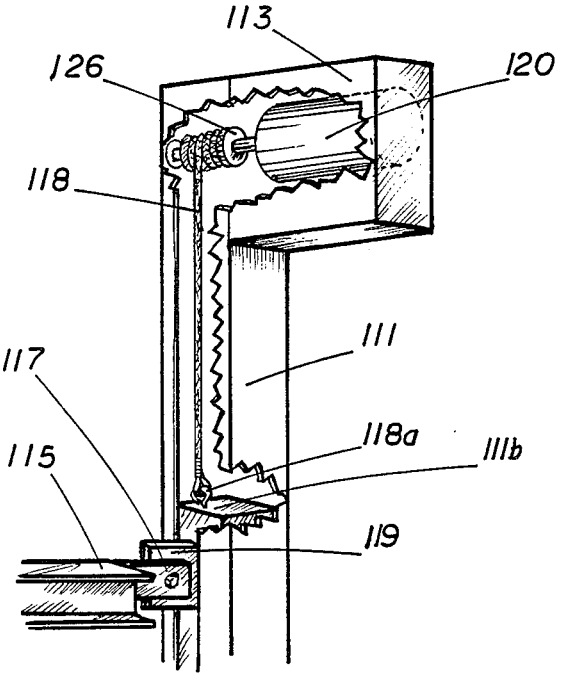
FIG. 4 is a view of a portion of the device as illustrated in FIG. 1 with partial cutaway.

Referring now to the drawings, the lifting device of this invention comprises a pair of support units 11 and 12. Each support unit is separately attached to the rear portion or transom 10a of the boat 10 so that the pair of units support the dinghy 100 which is positioned transversely to the boat 10.

The support units are of identical construction, each comprising a hollow vertical support member 111 which has a vertical slot 112 and which is attached to transom 10*a* by brackets 114. A motor housing 113 is mounted on support 111 and contains a motor and gearbox 120 which drives reel 126. Vertically movable support member 111 is a hollow, vertical extension member 111*a* with vertical slot 111*as*. Vertically movable in extension member 111*a* is a final extension 111*b*. Member 111*b* is connected by cable 118 to the reel 126. Extending horizontally from final extension 111*b* through the slots of the vertical support member and the vertical extension member is a support member 115 pivotable on anchor 119. Support member 115 has a transverse cradle 121 and is held firmly in place by angular support 116 which terminates on final extension member 111*b*.

Power for the motors 113 is supplied by the battery (not illustrated) of the boat through a central control 123 which is connected by conduits 124 and 125 to the motors and has switches to permit the operator to actuate the motors simultaneously or independently so as to provide proper lowering or raising.

When the dinghy 100 is in raised position it is held firmly in place by straps 122 which attach to brackets 122*a* and 122*b* on support members 115. When the dinghy 100 is in lower position sitting on the water 9 it can be easily moved out of or onto the cradles.

The device is preferably made of anodised aluminum to reduce both weight and corrosion. The straps 122 are preferable made of nylon for similar reasons.

I claim:

1. A lifting device for boats, comprising in combination a plurality of support units, each said support unit comprising:

(a) a hollow vertical support member having a vertical slot;

(b) means for attaching said hollow vertical support member to another surface;

(c) motor means mounted on said hollow vertical support member;

(d) a vertical extension member movable up and down in said hollow vertical support member;

(e) cable means connecting said motor means to said extension member; and (f) horizontal boat support means connected to said extension member through said slot;

said vertical extension member comprising a hollow first member having a vertical slot and movable in said hollow vertical support member and a second member movable in said first member; said horizontal boat support means being anchored to said second member; said device being characterized in that actuation of said motor means selectively raises or lowers a boat position on said boat support means.

2. The device of claim 1 wherein said horizontal boat support means includes cradle means for holding the bottom of a boat.

3. The device of claim 1 wherein said horizontal boat support means includes strap means for holding a boat firmly in position.

4. A plurality of units as described in claim 1 attached to a boat.

5. The device of claim 1 attached to another surface.

* * * * *